US010323895B2

(12) United States Patent
Westcott

(10) Patent No.: US 10,323,895 B2
(45) Date of Patent: Jun. 18, 2019

(54) UNIVERSAL ADAPTER END CAP FOR A FIREARM

(71) Applicant: Jonathan Westcott, Cambridge, MA (US)

(72) Inventor: Jonathan Westcott, Cambridge, MA (US)

( * ) Notice: Subject to any disclaimer, the term of this patent is extended or adjusted under 35 U.S.C. 154(b) by 0 days.

(21) Appl. No.: 15/676,988

(22) Filed: Aug. 14, 2017

(65) Prior Publication Data

US 2018/0259286 A1 Sep. 13, 2018

Related U.S. Application Data

(63) Continuation of application No. 15/395,706, filed on Dec. 30, 2016, now abandoned.

(60) Provisional application No. 62/273,121, filed on Dec. 30, 2015.

(51) Int. Cl.

| | |
|---|---|
| ***F41A 15/00*** | (2006.01) |
| ***F41A 21/32*** | (2006.01) |
| ***F41C 7/02*** | (2006.01) |
| ***F41A 9/72*** | (2006.01) |
| ***F41A 21/40*** | (2006.01) |

(52) U.S. Cl.

CPC ..... *F41A 21/325* (2013.01); *F41A 9/72* (2013.01); *F41A 21/40* (2013.01); *F41C 7/02* (2013.01)

(58) Field of Classification Search

CPC ..... F41C 23/10; F41C 23/16; F41C 23/22

USPC ..... 42/90

See application file for complete search history.

(56) References Cited

U.S. PATENT DOCUMENTS

| | | | | |
|---|---|---|---|---|
| 4,736,540 | A * | 4/1988 | Holmes | F41A 21/40 42/49.01 |
| 2004/0045209 | A1* | 3/2004 | Nielsen | F41G 1/35 42/146 |
| 2015/0013204 | A1* | 1/2015 | McNitt | F41C 27/16 42/90 |

OTHER PUBLICATIONS http://www.galls.com/steiner-mk7-integrated-shotgun-light, downloaded from the World Wide Web on Dec. 27, 2016.

* cited by examiner

*Primary Examiner* — J. Woodrow Eldred

(74) *Attorney, Agent, or Firm* — Hamilton, Brook, Smith & Reynolds, P.C.

(57) ABSTRACT

A device enabling a shotgun operator to carry an additional choke tube on the body of a shotgun is disclosed. Embodiments include a universal adapter end cap configured to be threaded onto the end of a shotgun magazine, the universal adapter end cap including an opposite end adapted to secure an accessory (e.g., shotgun choke tube). Accordingly, embodiments enables an operator to stow and carry a second unused choke tube at the end of the shotgun magazine. Some embodiments of the universal adapter end cap include a threaded opening that enables the choke tube to be threaded into the threaded opening. Some embodiments provide threads constructed from flexible material to enable both threading and push insertion of an accessory into the universal adapter end cap.

6 Claims, 6 Drawing Sheets

UNIVERSAL ADAPTER END CAP FOR A FIREARM

RELATED APPLICATIONS

This application is a continuation of U.S. application Ser. No. 15/395,706, filed Dec. 30, 2016, which claims the benefit of U.S. Provisional Application No. 62/273,121, filed on Dec. 30, 2015. The entire teachings of the above applications are incorporated herein by reference.

BACKGROUND

Shotgun barrels often include a choke tube at the distal (i.e., shot-expelling) end. The typical shotgun choke tube is inserted into the barrel to constrict the shotgun's shot charge as the shot charge leaves the muzzle, thereby modifying the spread of the shot charge on its way to a target. For example, a choke tube with more constriction provides for a denser shot pattern at longer range, and a less constrictive choke tube would provide for a less dense shot pattern. Typical shotgun coke tubes screw into the muzzle of the barrel and enable multiple constrictions to be used on the same barrel by changing one choke tube for another.

SUMMARY

There exists a need for a device enabling a shotgun operator to carry an additional choke tube on the body of a shotgun. Typical pump-action and semi-automatic shotguns include a magazine tube positioned under the barrel to store the additional ammunition cartridges with an end cap threaded onto the distal end of the magazine. Prior art end caps simply serve to close the end of the shotgun magazine and secure an internal spring. Additionally, some prior art end caps may also secure the firearm's barrel assembly to the lower receiver and/or magazine tube. Embodiments of the present invention include a universal adapter end cap having a first end configured to be threaded onto the end of a shotgun magazine and a second end adapted to secure an accessory (e.g., a choke tube) to the shotgun. Accordingly, embodiments enable an operator to stow and carry a second unused choke tube, or any other accessory at the end of the shotgun magazine.

Some embodiments of the universal adapter end cap include a threaded opening that enables a choke tube to be threaded into the threaded opening. Some embodiments provide threads constructed from flexible material to enables both threading and push insertion of the choke tube into the universal adapter end cap.

An example embodiment is a universal adapter end cap for a magazine of a firearm, comprising a first end having a threaded opening adapted to secure the universal adapter end cap to a corresponding threaded end of the magazine of the firearm, and a second end opposite to the first end, the second end having an accessory interface adapted to secure to the firearm a corresponding interface of an accessory via the universal adapter end cap. The firearm may be any type of firearm with a magazine having (or being adaptable to have) a threaded end where the universal adapter end cap may be attached. According to some embodiments, the firearm may be a shotgun, and the threaded opening may be adapted to replace an end cap of the shotgun magazine. The accessory, for non-limiting example, may be a shotgun choke tube, and the corresponding threaded end of the shotgun choke tube may be adapted to thread the choke tube into a barrel of a shotgun.

In some embodiments, the threaded opening of the first end is a first threaded opening and the accessory interface of the second end comprises a second threaded opening having a depth along the second direction, where the depth enables the corresponding threaded end of the choke tube to be inserted into the second threaded opening. In some embodiments, the accessory interface of the second end is a threaded opening, with the threads of the second threaded opening being constructed from a pliable material enabling both push-insertion and pull-removal of an accessory (e.g., a choke tube). The second end may be constructed from a pliable material, and the accessory interface is an opening enabling both push-insertion and pull-removal of the accessory (e.g., choke tube). The pliable material may enable accessories of a range of diameters to be inserted into the second end, based on, for example, a durometer of the pliable material and an inner diameter of the opening of the second end.

According to some embodiments, enabling both push-insertion and pull-removal of an accessory allows the user of the firearm to quickly and easily insert and remove accessory from the universal adapter end cap at the distal end of the firearm. This makes the accessory more accessible to the user of the firearm than if the accessory were stored in a pouch or pocket.

In yet another embodiment, the accessory interface of the second end defines an opening and an inner surface of the opening includes one or more pliable interface features. The pliable interface features may protrude from the inner surface and enables both push-insertion and pull-removal of the accessory (e.g., choke tube). The one or more pliable interface features may be pliable inserts adapted to be removably coupled to the inner surface. The one or more pliable interface features may be threaded to accept the corresponding threads of the accessory (e.g., choke tube). The one or more pliable interface features may be flexible bands suspended in the opening and adapted to be deflected by the accessory (e.g., choke tube) upon insertion of the accessory, the deflection of the flexible bands providing an interface fit against the accessory. The one or more pliable interface features may be one or more flexible toroidal gaskets positioned in corresponding circumferential grooves on the inner face of the opening.

In some embodiments, the accessory interface of the universal adapter end cap defines an opening with an inner surface, the inner surface including one or more press fit detents. The one or more press fit detents protruding from the inner surface and enabling both push-insertion and pull-removal of the accessory.

In some embodiments, the threaded opening is a first threaded opening facing in a first direction, the accessory interface is a second threaded opening of the second end, and the corresponding interface of the accessory is a corresponding threaded end of the accessory, with the second threaded opening facing in a second direction, the second direction being opposite to the first direction. The first and second ends may be first and second ends of a main body, and the main body may be constructed from a material selected from the group consisting of: metal, rubber, polymer, or glass filled nylon. The accessory may be selected from the group consisting of: a choke tube, flashlight, bipod, storage container defining storage space, first-aid/survival kit, ammunition, duck caller, weight or laser sight.

The universal adapter end cap may further include a coupling interface between the first and second ends, the coupling interface removably coupling the second end to the first end, and thereby enable a two-part construction of the universal adapter end, with the second end being interchangeable for different accessories or, for example, different choke tube sizes.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION

A description of example embodiments of the invention follows.

Figure 1A:
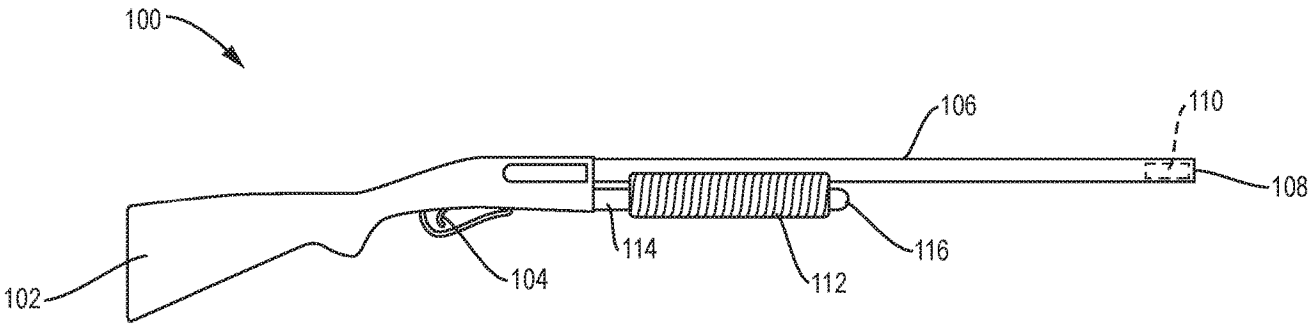
FIG. 1A is an illustration of a typical pump-action or semi-automatic shotgun with an end cap and a choke tube.

FIG. 1A shows a typical pump action or semi-automatic shotgun 100 profile, the shotgun 100 having a rear stock 102, trigger 104, barrel 106, muzzle 108, choke tube 110 (dashed lines), fore-end 112, and magazine tube 114 capped at the distal end by an end cap 116.

In operation, the choke tube 110 is threaded into the muzzle 108 of the barrel 106 and can be removed by a user with a hand or a wrench. The removal of the choke tube 110 is an operation that can be done prior to using the shotgun 100 or while using the shotgun 100, between discharges. Additionally, the end cap 116 is threaded onto the end of the magazine tube 114, and typically secures one end of a spring inside the magazine tube.

Figure 1B:
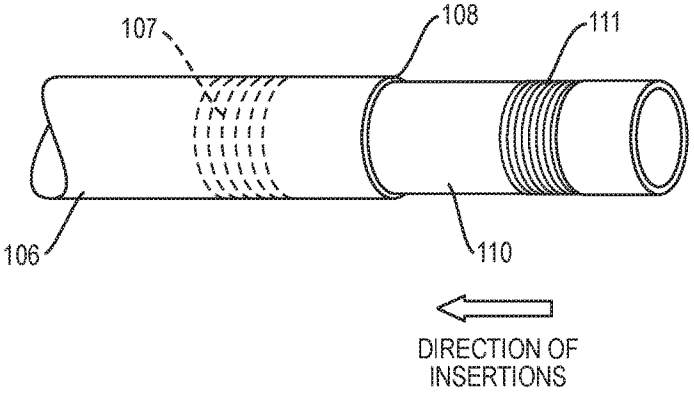
FIG. 1B is an illustration of a choke tube being inserted into the distal end of a shotgun barrel.

FIG. 1B shows a typical shotgun barrel 106 and choke tube 110, with the choke tube 110 partially inserted into the barrel 106 and not yet threaded into corresponding interior threads 107 of the barrel 108. The threads 111 of the choke tube 110 may be positioned in the middle of the choke tube 110 (as shown) or may also be at the proximal end (the end of the choke tube 110 first inserted into the barrel 108), depending on the manufacturer's design choice in locating the internal threads 107. Typically, each individual manufacturer requires a different corresponding choke tube 110 design.

Figure 2A:
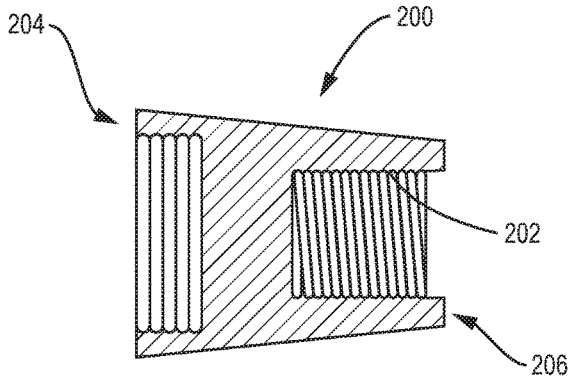
FIG. 2 is an illustration of an adapter end cap embodiment having interior threads configured to accept the mating threads of a choke tube.
Figure 2B:
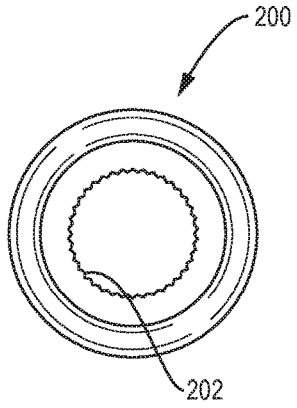

FIG. 2 is an illustration of an example adapter end cap embodiment 200 having interior threads 202 configured to accept mating threads an accessory (e.g., choke tube). The example adapter end cap embodiment 200 has a proximal end 204 configured to thread onto the end of a shogun magazine tube 114 (replacing a typical end cap 116) and a distal end 206 configured to accept an accessory (e.g., shotgun choke tube 110). The distal end 206 includes an opening facing away from the proximal end 204 and includes interior threads 202 enabling a choke tube 110 to be threaded into the adapter end cap 200.

In operation, a user replaces the shotgun's end cap 116 (FIG. 1A) with the adapter end cap 200 of FIG. 2, thereby enabling the user to attach an accessory (e.g., second choke tube) to the adapter end cap 200 and carry the attached accessory in an easy-to-reach location on the shotgun 100. FIG. 2 also shows a front view of the adapter end cap 200, illustrating the circular shape of the exterior of the adapter end cap 200 and the interior threads 202 in the distal end 206 of the adapter end cap 200.

Figure 3:
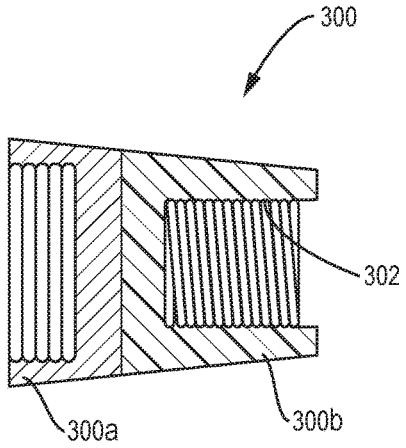
FIG. 3 is an illustration of an adapter end cap embodiment having a two-part construction with a distal end having interior threads constructed from a pliable material.

FIG. 3 is an illustration of an adapter end cap embodiment 300 having a two-part construction with a distal end 300*b* and interior threads 302 constructed from a pliable material. FIG. 3 shows an adapter end cap 300 constructed from two different materials. The proximal end 300*a* is constructed from a durable and hard material, such as metal or ballistic nylon and the distal end 300*b* is constructed from a pliable material, such as rubber or a flexible polymer. The distal end 300*b* also includes an opening with interior threads 302 configured to accept an accessory (e.g., shotgun choke tube 110). In operation, the pliable material of the distal end 300*b* enables a user to either thread an accessory (e.g., choke tube 110) into the interior threading 302 or simply push-fit the accessory (e.g., choke tube 110) into the opening of the distal end 300*b*. The pliable material also enables accessories of slightly larger or smaller diameters, or with different thread patterns, to be secured by an interface fit against the inner threads 302.

Additionally, the distal end 300*b* of the adapter end cap 300 may be constructed as a separate part to be removably coupled to the proximal end 300*a*, thereby enabling a user to swap the distal end 300*b* part for a separate distal end (not shown) of a different size or material, or for a separate distal end (not shown) having a different accessory attachment configuration.

Figure 4:
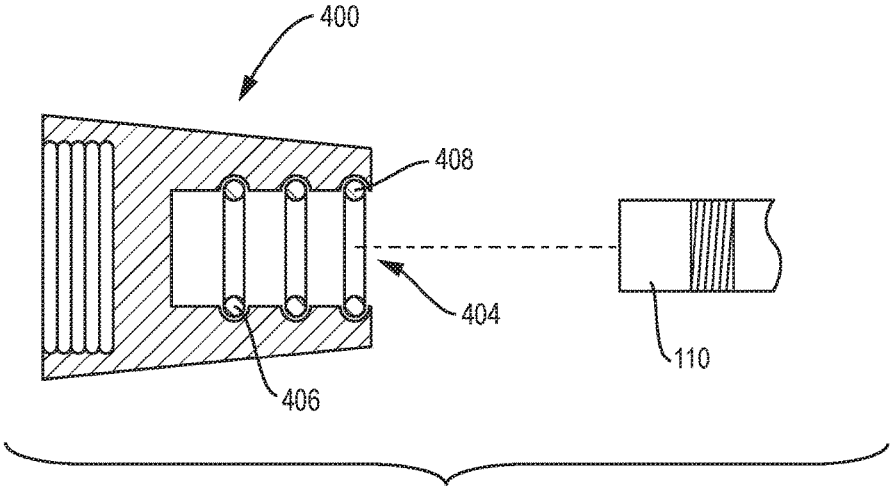
FIG. 4 is an illustration of an adapter end cap embodiment having pliable interior fitting features for interfacing with the external surface of a choke tube.

FIG. 4 is an illustration of an adapter end cap embodiment 400 having pliable interior fitting features 402 for interfacing with the external surface of an accessory (e.g., choke tube 110). FIG. 4 shows an adapter end cap 400 where the interior of the distal opening 404 includes three grooves 406 holding three pliable gasket rings 408. The pliable gasket rings 408 are positioned to accept an accessory (e.g., choke tube 110) that is push-fit into the distal opening 404 of the adapter end cap 400. It should be understood that other numbers and dimensions of pliable gasket rings 408 may alternatively be employed.

In operation, the pliable gasket rings 408 are deflected by the outer surface of the accessory (e.g., choke tube 110) as it is inserted into the adapter end cap 400, and the deflection of the pliable gasket rings 408 creates an interface fit between the adapter end cap 400 and the accessory (e.g., choke tube 110). Additionally, by choosing the properties of the pliable gasket rings 408, such as the durometer and thickness, the adapter end cap 400 may accept a wide range of accessories) by being able to interface fit against a range of exterior diameters of the accessories.

Figure 5:
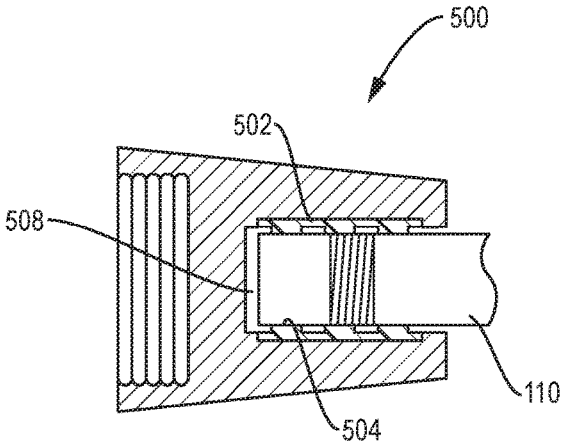
FIG. 5 is an illustration of an adapter end cap embodiment having an insert including interface fitting protrusions adapted to secure a choke tube by forming an interference fit against the external surface of the choke tube.

FIG. 5 is an illustration of an adapter end cap embodiment 500 having an insert 502 including interface fitting protrusions 504 perpendicular to the length of the adapter end cap 500 and are adapted to secure an accessory (e.g., choke tube 110) by forming an interference fit against the external surface of the accessory (e.g., choke tube 110). FIG. 5 shows an adapter end cap embodiment 500 having a distal opening 508 with a pliable insert 504 secured inside the distal opening 508 and forming the circumferential surface of the distal opening 508. The pliable insert 502 includes one or a plurality of interface fitting protrusions 504 projecting into the volume of the distal opening 508. The interface fitting protrusions 504 are configured to create an interface fit with choke tube 110, as shown inserted into the adapter end cap 500.

In operation, a user can swap the pliable insert 502 for one of a different material or internal diameter, for example, to accept accessories of various external diameters or to improve performance in different environments by choosing a material suited to perform in a given environment, such as hotter and colder temperatures. Additionally, the removability of the pliable insert 502 enables a user to easily swap out a worn-out pliable insert 502 for a new one, or clean the pliable insert 502 and distal opening 508 after repeated use of the adapter end cap 500 accumulates grease or grit in the distal opening 508.

Figure 6A:
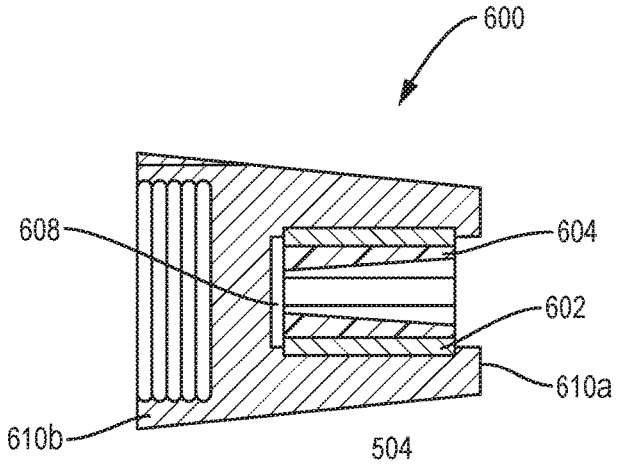
FIG. 6A is an illustration of an adapter end cap embodiment having an insert including interface fitting protrusions positioned parallel to the length of the adapter end cap.

FIG. 6A is an illustration of an adapter end cap embodiment 600 having an insert 602 including interface fitting protrusions 604 parallel to the length of the adapter end cap 600 and are adapted to secure an accessory (e.g., choke tube 110) by forming an interface fit against the external surface of the accessory (e.g., choke tube 110). FIG. 6A shows an adapter end cap embodiment 600 having a distal opening 608 with a pliable insert 602 secured inside the distal opening 608 and forming the circumferential surface of the distal opening 608. The pliable insert 602 includes one or a plurality of interface fitting protrusions 604 projecting into the volume of the distal opening 608. The interface fitting protrusions 604 are configured parallel along the length of the opening with the height of the protrusions 604 increasing further into the distal opening 608. Alternatively, the height of the protrusions 604 may be uniform throughout the length of the distal opening 608. In some embodiments, the interface fitting protrusions 604 are made of pliable material, and as the accessory is inserted, the protrusions 604 create an interface fit with the accessory. It should be understood that other numbers and dimensions of pliable protrusions 604 may alternatively be employed.

Because the diameter of the distal opening 608 gradually decreases from the distal end 610*a* toward the proximal end 610*b*, the adapter end cap 600 is able to accept accessories of various external diameters. In operation, the user pushes the accessory into the distal opening 608 until the accessory is held firmly in place. The accessory can then be removed by pulling the accessory out of the distal opening 608. This enables the user to quickly and easily insert and remove the accessory from the adapter end cap 600, without the need to thread and unthread the accessory into the adapter end cap 600.

Figure 6B:
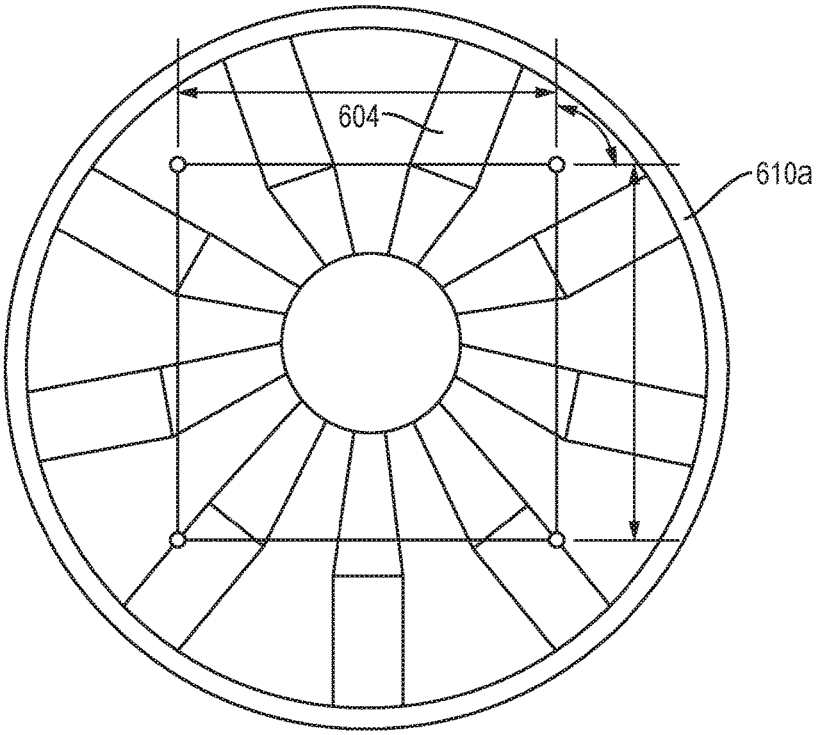
FIG. 6B is an illustration of the front view of an adapter end cap embodiment including interface fitting protrusions positioned parallel to the length of the adapter end cap.

FIG. 6B is an illustration of the front view of the adapter end cap embodiment 600 including the interface fitting protrusions 604. According to some embodiments, the protrusions 604 may be rectangular and run from the front of the distal end 610*a* toward the proximal end 610*b* of the adapter end cap 600.

Figure 7:
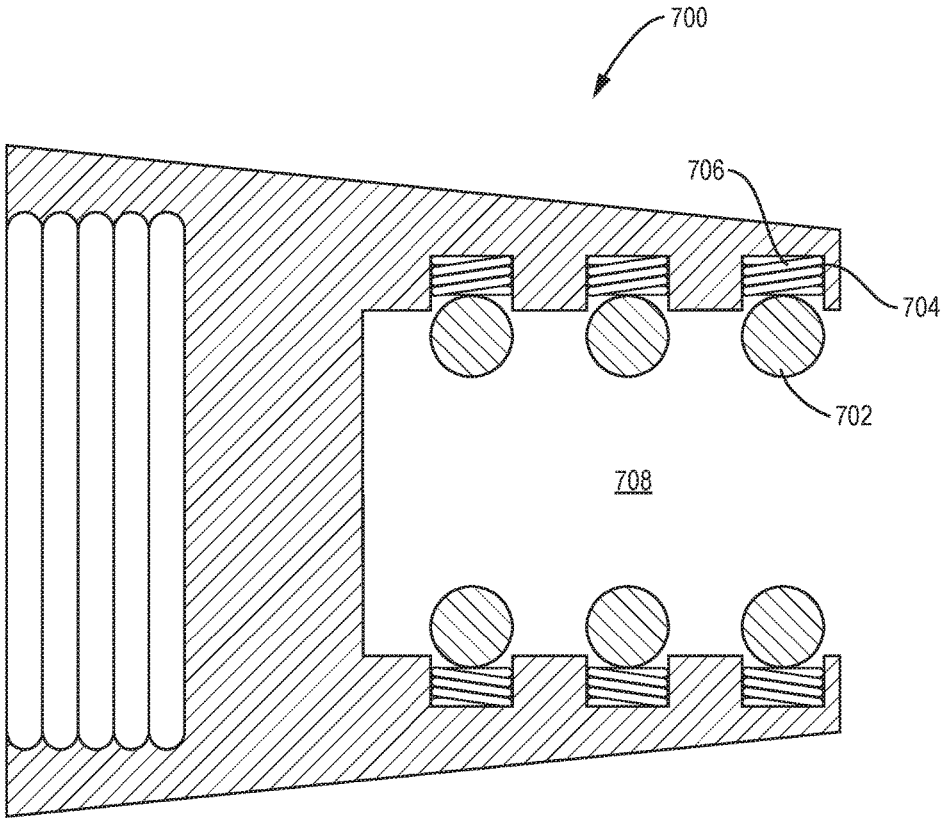
FIG. 7 is an illustration of an adapter end cap embodiment having interior press fit ball detents for interfacing with the external surface of an accessory.

FIG. 7 is an illustration of an adapter end cap embodiment 700 having one or more interior press fit ball detents 702 for interfacing with the external surface of an accessory. FIG. 7 shows an adapter end cap 700 in which the interior of the distal opening 708 includes six press fit ball detents 702. Six press fit ball detents 702 are shown as an example; it is understood that the adapter end cap 700 may have any number of press fit ball detents 702 to interface with the external surface of an accessory (e.g., a choke tube). According to some embodiments, the press fit ball detent 702 may be held in cylindrical cavities 704 inside the adapter end cap 700. The ball detents may be pressed toward the distal opening 708 by springs 706. The ball detents 702 may be comprised of any type of material including metal, plastic, rubber, nylon, or any pliable material.

As an accessory is inserted into the distal opening 708, pressure is exerted onto the external surface of the accessory by the press fit ball detents 702. The pressure exerted onto the accessory holds the accessory in the distal opening 708 of the adapter end cap 700 in a manner enabling a user to easily push the accessory into the distal opening 708 for storage and pull the accessory out of the adapter end cap 700. In some embodiments, the accessory may have corresponding grooves or holes for the ball detents 702 to rest in, creating a stronger grip between the adapter end cap 700 and the accessory. It should be understood that other numbers, dimensions, and placements of press fit ball detents 702 may alternatively be employed.

Figure 8A:
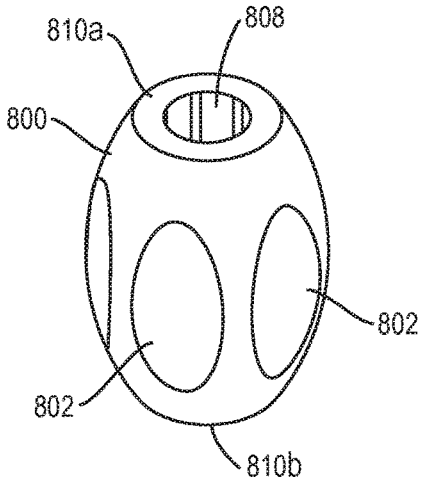
FIGS. 8A-8E are illustrations of an example adapter end cap embodiment.

FIGS. 8A-8E are illustrations of an example adapter end cap embodiment 800. FIG. 8A is an isometric view of the example adapter end cap embodiment 800. According to this embodiment, the adapter end cap 800 has shape similar to a prolate spheroid with indents 802 around the outside of the adapter end cap 800. The indents 802 provide a user extra grip for threading the adapter end cap 800 onto and off of a firearm magazine. FIG. 8A shows the distal end 810*a* and the distal opening 808 at the top of the adapter end cap 800, and the proximal end 810*b* at the bottom of the adapter end cap 800.

Figure 8B:
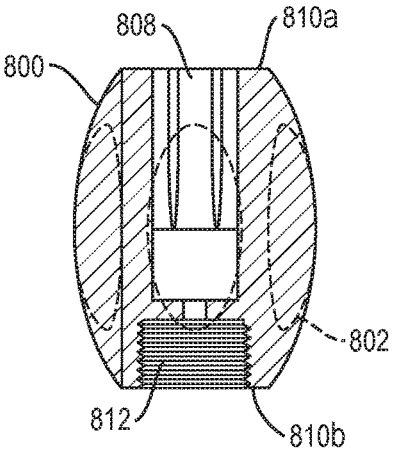

FIG. 8B is a semitransparent side view of the adapter end cap 800. FIG. 8B shows the distal opening 808 for accepting the accessory and the threads 812 at the proximal end 810*b* for accepting a firearm magazine tube.

Figure 8C:
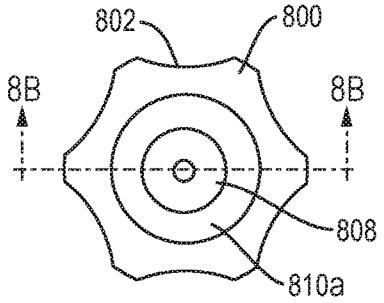
Figure 8D:
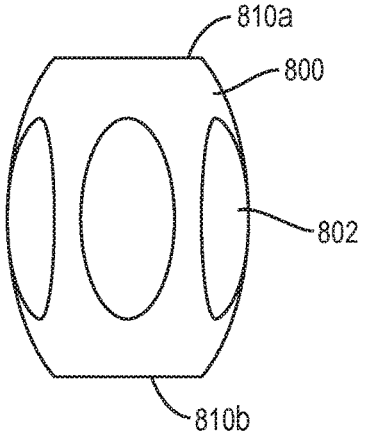
Figure 8E:
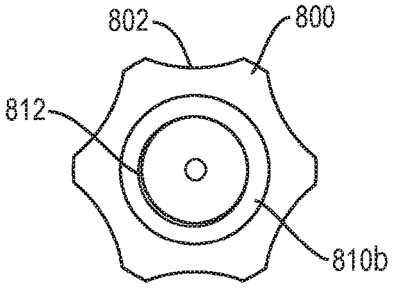

FIG. 8C is a top view of the adapter end cap 800, FIG. 8D is a side view of the adapter end cap 800, and FIG. 8E is a bottom view of the adapter end cap 800.

While this invention has been particularly shown and described with references to example embodiments thereof, it will be understood by those skilled in the art that various changes in form and details may be made therein without departing from the scope of the invention encompassed by the appended claims.

What is claimed is:

1. A universal adapter end cap for a magazine of a firearm, the universal adapter end cap comprising:

a first end having a first threaded opening adapted to secure the universal adapter end cap to a corresponding threaded end of the magazine of the firearm;

a second end opposite to the first end, the second end having a second threaded opening adapted to receive a threaded end of a choke tube; and wherein the first threaded opening faces in a first direction, and wherein the second threaded opening faces in a second direction, the second direction being opposite to the first direction.

2. The universal adapter end cap of claim 1, wherein the magazine of the firearm is a shotgun magazine.

3. The universal adapter end cap of claim 2, wherein the threaded end of the choke tube is adapted to thread the choke tube into a barrel of a shotgun.

4. The universal adapter end cap of claim 3, wherein the second threaded opening has a depth along the second end, the depth enabling the threaded end of the choke tube to be inserted into the second threaded opening.

5. The universal adapter end cap of claim 4, wherein threads of the second threaded opening are constructed from a pliable material enabling both push-insertion and pull-removal of the threaded end of the choke tube.

6. The universal adapter end cap of claim 1, wherein the first and second ends are first and second ends of a main body, the main body being constructed from a material selected from the group consisting of: metal, rubber, polymer, or glass-filled nylon.

* * * * *